US009180518B2

(12) United States Patent
Gurosik et al.

(10) Patent No.: US 9,180,518 B2
(45) Date of Patent: Nov. 10, 2015

(54) POWDER METAL DIE FILLING

(75) Inventors: John D. Gurosik, Emporium, PA (US); Keith M. Schalles, Driftwood, PA (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 1027 days.

(21) Appl. No.: 13/320,867

(22) PCT Filed: May 17, 2010

(86) PCT No.: PCT/US2010/035095

§ 371 (c)(1), (2), (4) Date: Feb. 3, 2012

(87) PCT Pub. No.: WO2010/135232

PCT Pub. Date: Nov. 25, 2010

(65) Prior Publication Data

US 2012/0118104 A1 May 17, 2012

Related U.S. Application Data

(60) Provisional application No. 61/179,125, filed on May 18, 2009, provisional application No. 61/225,799, filed on Jul. 15, 2009.

(51) Int. Cl.

| | |
|---|---|
| ***B22F 5/10*** | (2006.01) |
| ***B22F 3/00*** | (2006.01) |
| *B22F 3/03* | (2006.01) |

(52) U.S. Cl.

CPC . *B22F 5/10* (2013.01); *B22F 3/004* (2013.01); *B22F 2003/033* (2013.01); *B22F 2998/00* (2013.01)

(58) Field of Classification Search

CPC ..... B22F 3/004

See application file for complete search history.

(56) References Cited

U.S. PATENT DOCUMENTS 2,447,434 A * 8/1948 Schwarzkopf ..... 419/68
4,390,488 A 6/1983 Wessel (Continued)

FOREIGN PATENT DOCUMENTS

JP S5571697 U 5/1980
JP S5875721 U 5/1983

OTHER PUBLICATIONS

State Intellectual Property Office of People's Republic of China, First Office Action and Search Report, Application No. 201080021529.1, Apr. 27, 2013, 11 pages [English Language Translation Only].

State Intellectual Property Office of People's Republic of China, Second Office Action, Application No. 201080021529.1, Dec. 13, 2013, 11 pages [English Language Translation Only].

(Continued)

*Primary Examiner* — George Wyszomierski
*Assistant Examiner* — Ngoclan T Mai
(74) *Attorney, Agent, or Firm* — Quarles & Brady LLP

(57) ABSTRACT

The disclosed method provides a way to fabricate a powder metal compact implementing a top fill through one or more of the upper tool members. The top fill step allows for pre-compaction chamber, defined at least in part by at least one of the upper tool members, to be filled with a powder metal after the upper tool member is initially lowered, but before compaction of the powder metal. The manner in which the pre-compaction chamber is filled allows for the formation of complex geometries in powder metal compacts that are not obtainable using conventional lower tool powder transfer motions and further minimizes or avoids unacceptable variations in powder fill to final part ratios across the powder metal compact.

15 Claims, 10 Drawing Sheets

(56) References Cited

U.S. PATENT DOCUMENTS

| | | | | |
|---|---|---|---|---|
| 5,897,826 | A * | 4/1999 | Lashmore et al. | 264/437 |
| 6,099,772 | A | 8/2000 | Hinzmann et al. | |
| 6,440,357 | B1 | 8/2002 | Hinzmann | |
| 6,705,848 | B2 | 3/2004 | Scancarello | |
| 7,086,151 | B2 | 8/2006 | Scancarello | |
| 2005/0089436 | A1 | 4/2005 | Tokita | |
| 2008/0298996 | A1 | 12/2008 | Kuplen et al. | |

OTHER PUBLICATIONS

State Intellectual Property Office of People's Republic of China, Third Office Action, Application No. 201080021529.1, Jun. 5, 2014, 6 pages [English Language Translation Only].

International Search Report and Written Opinion as mailed on Jul. 14, 2010 for International Application No. PCT/US2010/035095.

Japan Patent Office, Notification of Reason for Refusal, Application No. 2012-511933, Aug. 12, 2014.

* cited by examiner

POWDER METAL DIE FILLING

CROSS-REFERENCES TO RELATED APPLICATIONS

This application represents the national stage entry of PCT International Application No. PCT/US2010/035095 filed on May 17, 2010 and claims the benefit of U.S. provisional patent application No. 61/179,125 entitled "Powder Metal Die Filling" filed on May 18, 2009, and U.S. provisional patent application No. 61/225,799 entitled "Powder Metal Die Filling" filed on Jul. 15, 2009. The contents of both of these applications are hereby incorporated by referenced as if set forth in their entirety herein.

STATEMENT CONCERNING FEDERALLY SPONSORED RESEARCH OR DEVELOPMENT

Not applicable.

BACKGROUND OF THE INVENTION

This invention relates to powder metal components and the process used to make them. In particular, this invention relates to a method of making parts having complex shapes using powder metal compaction.

Powder metallurgy provides a method of forming metallic parts. Making a part from powder metal typically includes the steps of filling a tool and die set with a powder metal powder, uni-axially compacting the metal powder using the tool and die set to form a powder metal compact, and sintering the powder metal compact to bond the particles of the powder metal compact together to form a final powder metal part. Although the final powder metal part is usually less than fully dense, a powder metal part has exceptional dimensional accuracy in comparison to parts made using other metal fabrication techniques.

To form the top side features in a powder metal compact, between the fill and compaction step, powder metal from the lower portion of the die is transferred upward by the relative movement of the lower tool members. If properly done, this powder transfer moves the powder to the appropriate location within the die cavity for compaction while simultaneously maintaining a powder fill to final part ratio of approximately 2:1 over the different vertical columns of the die cavity in the direction of compaction. If the powder fill to final part ratio is not maintained across the various features of the part, then the final part may have unacceptable variations in density.

Even though some parts having complex shapes can be made using powder metallurgy, certain geometries cannot be produced as a single part using the above-described techniques. To make powder metal parts having these geometries, two or more sections of the part need to be separately compacted and then joined together after compaction. However, two or more separate compaction steps and a joining step is time consuming, costly, and is likely to require significant post-sintering secondary operations.

Hence, a need exists for a way to form powder metal parts having complex geometries.

SUMMARY OF THE INVENTION

A method of forming a powder metal compact is disclosed. A tool set is utilized including a die having a die cavity, at least one lower tool member, and at least one upper tool member. At least one powder feed chute extends through one of the upper tool members. The lower tool member or members are inserted into the die cavity. The die cavity is filled with a powder metal in a first fill step. An upper tool member or members are then lowered to define a pre-compaction chamber. The pre-compaction chamber includes a filled section that was filled with the powder metal during the first fill step and an unfilled section that is not yet filled with the powder metal. The unfilled section of the pre-compaction chamber is filled with powder metal in a second fill step via the at least one powder feed chute that extends through the at least one upper tool member into the pre-compaction chamber. The powder metal is compacted along an axis of compaction to form a powder metal compact. The powder metal compact is then ejected from the die cavity.

The second fill step may include shuttling the powder metal from a hopper system to the upper tool member using a feed plate assembly. The feed plate assembly may include a sliding plate that has at least one powder cavity of a metered volume formed in the sliding plate. The sliding plate may be moveable between a first position and a second position. In the first position, the powder cavity or cavities are located beneath the hopper system to receive a charge of powder metal equal in volume to the powder cavity or cavities. In the second position, the powder cavity or cavities are placed in communication with the powder feed chute or chutes in the upper tool member to allow the charge of powder metal to be fed to the pre-compaction chamber.

There may also be a support block between the feed plate assembly and the upper tool member. The feed plate assembly may be positioned on a top side of the support block and the upper tool member may be attached to a bottom side of the support block. The support block may include at least one powder feed chute that places the powder cavity or cavities of the sliding plate in communication with the powder feed chute or chutes of the upper tool member when the sliding plate is in the second position.

The sliding plate may include a slot through which other upper tool member or members extend in both the first position and the second position of the sliding plate. The sliding plate may have a plurality of powder cavities that are not co-axial with the upper tool member or members that extend through the slot in the sliding plate.

The powder feed chute or chutes in the upper tool member may extend through the upper tool member at an angle relative to the axis of compaction.

The tool set may include an upper inner punch, an upper middle punch surrounding at least a portion of the upper inner punch, and an upper outer punch surrounding at least a portion of the upper middle punch. The step of lowering the upper tool member or members to define the pre-compaction chamber may include lowering the upper outer punch. The step of lowering the upper tool member or members to define the pre-compaction chamber may further include lowering the upper inner punch to form a cylindrical cavity or the like over the die cavity. During the second fill step, the upper middle punch may be in a retracted position to place the powder feed chute or chutes of the upper outer punch in communication with the pre-compaction chamber. During the step of compacting the powder metal, the upper middle punch may be lowered such that a surface of the upper middle punch slides past an opening of the powder feed chute or chutes in the upper outer punch to remove the powder feed chute or chutes from communication with the pre-compaction chamber.

The powder metal compact formed by the method may have at least two different cross sections taken perpendicular to the axis of compaction of the powder metal compact. Each of the two cross sections may have a first filled powder area that is not included in the other of the cross sections. Each of the two cross sections may also have a second filled powder area that is included in the other of the cross sections. This part geometry may be achieved using a top fill during the second fill step and not by a conventional powder transfer motion of the lower tool member or members. A ratio of a powder fill to a final powder metal compact may be approximately 2:1 across the various vertical columns of the die cavity.

The first fill step may be performed by placing a feed shoe over the die cavity.

The second fill step may be performed by gravity.

The step of lowering the upper tool member or members to define a pre-compaction chamber may include moving a lower surface or surfaces of the upper tool member or members flush with a powder metal fill surface of the powder metal from the first fill step.

The method may further include the step of sintering the powder metal compact to form a sintered powder metal part. Thus, a sintered powder metal part made by the method is also disclosed.

Likewise, a powder metal compact made by the method is disclosed. As stated above, the powder metal compact may have at least two different cross sections taken perpendicular to the axis of compaction of the powder metal compact. Each of the different cross sections have a first filled area of powder metal that is included in the other of the different cross sections and a second filled area of powder metal that is not included in the other of the different cross sections.

Thus, the disclosed method provides a way to fabricate a powder metal compact using a top fill step through one or more of the upper tool members. The top fill step allows for pre-compaction chamber, formed at least in part by the upper tool members, to be filled with a powder metal in a manner that is not possible using conventional lower tool powder transfer motions without complex lower tooling members. Further, the manner in which the pre-compaction chamber is filled avoids unacceptable variations in powder fill to final part ratios across the powder metal compact.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
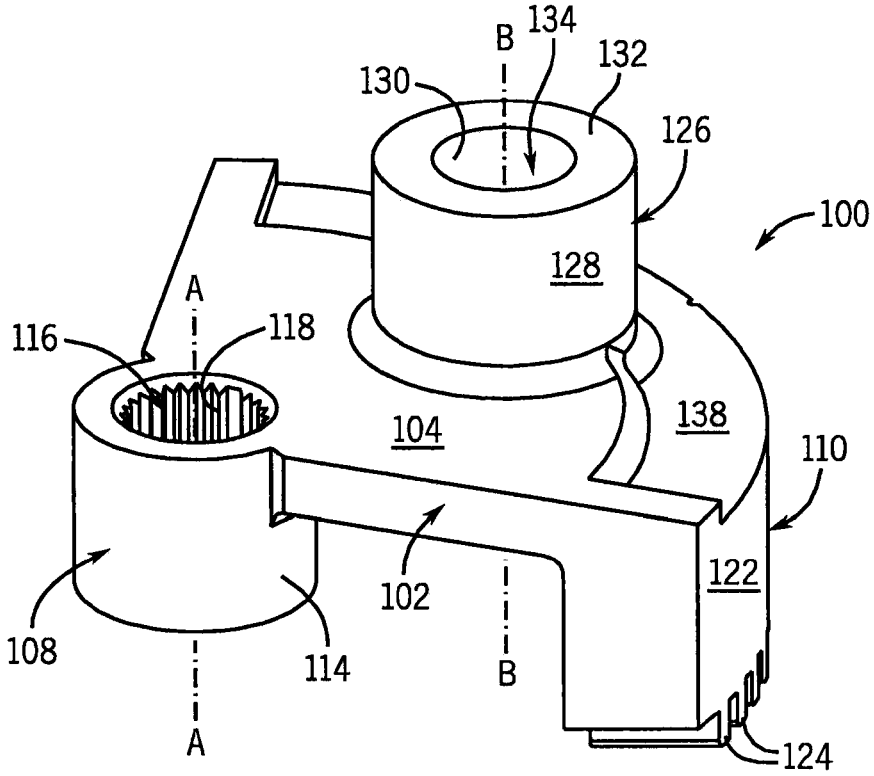
FIG. 1 is a top perspective view of a segment gear showing a hub side of the gear.
Figure 2:
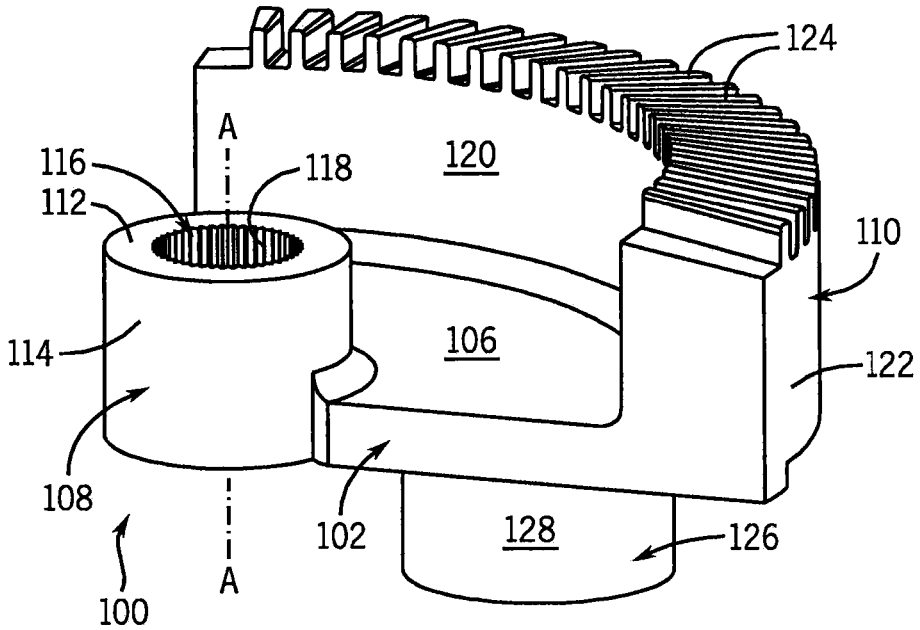
FIG. 2 is a bottom perspective view of the segment gear of FIG. 1 showing the axially-facing gear teeth.
Figure 3:
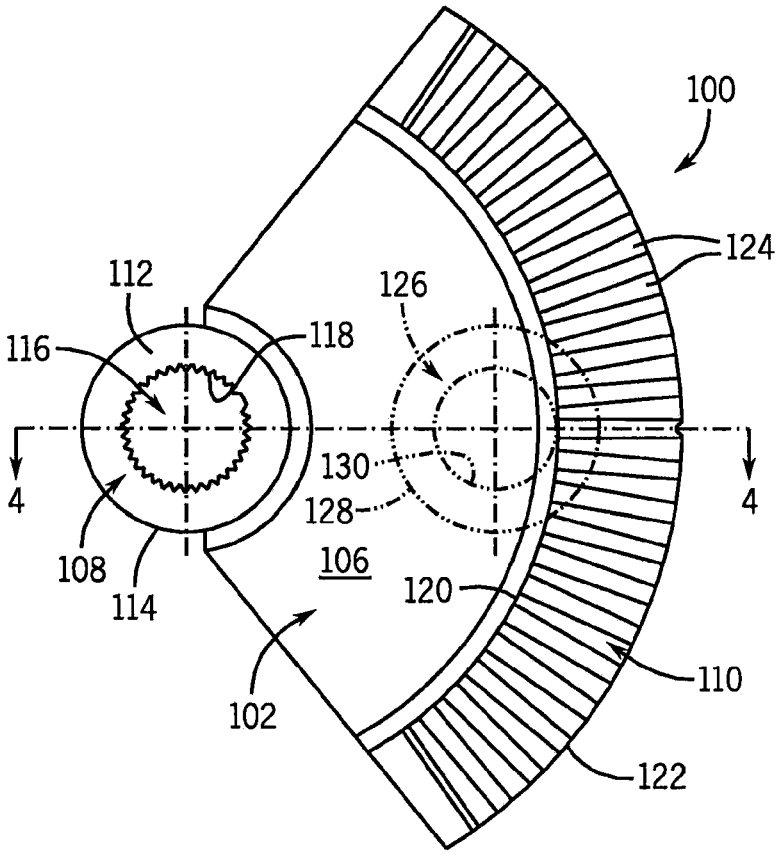
FIG. 3 is a top plan view of the segment gear of FIG. 1.

Referring first to FIGS. 1-4, a one piece segment gear 100 is shown. The segment gear 100 is fabricated as a single powder metal compact using the powder metal processes according to a process 200 described below. However, the structure of the segment gear 100 is now described to provide context for the steps of the process 200.

The segment gear 100 is a powder metal part which is formed by compression along an axis of compaction which is parallel to axis A-A and B-B. The segment gear 100 includes a pie-shaped body section 102 having a top surface 104 and a bottom surface 106 which are generally parallel to one another and which are both perpendicular to axis A-A. The body section 102 extends from a central hub 108 at an axis A-A to an arcuate wall 110 at an outer periphery of the segment gear 100.

The central hub 108 is generally cylindrically-shaped and extends downward from the bottom surface 106 of the body section 102. The central hub 108 and has a lower axial surface 112, a radially-outward facing surface 114, and an axially-extending through hole 116 which extends from the top surface 104 to the lower axial surface 112. The axially-extending through hole 116 has radially-inward facing splines 118 formed therein.

The arcuate wall 110 extends downward from the bottom surface 106 of the body section 102. The arcuate wall 110 includes a radially-inward facing surface 120 and a radially-outward facing surface 122. On the downward facing surface between the radially-inward facing surface 120 and the radially-outward facing surface 122 of the arcuate wall 110, a plurality of gear teeth 124 are formed. In the form shown, the gear teeth 124 extend in a generally radially direction relative to axis A-A although the planes defining the tips of the gear teeth 124 are non-perpendicular to the axis A-A.

A top side hub 126 is formed on the top surface 104 of the body section 102 and extends along axis B-B which is parallel to, but spaced from, axis A-A. The top side hub 126 is generally cylindrically-shaped having a radially-outward facing surface 128, a radially-inward facing surface 130, and an upper axial surface 132. The radially-inward facing surface 130 defines a cylindrically-shaped cavity 134 in the top side hub 126. A lower surface 136 of the cavity 134 is essentially parallel with the top surface 104 of the body section 102.

Figure 4:
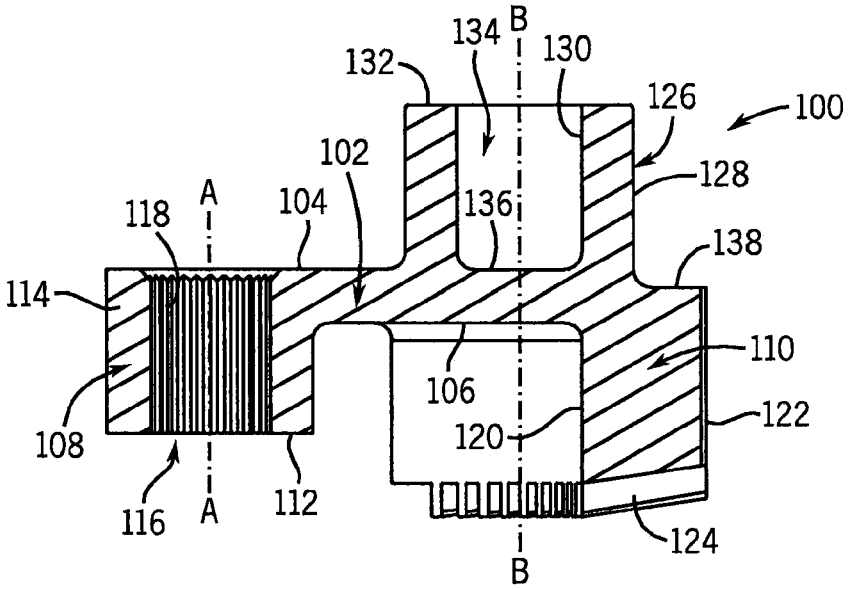
FIG. 4 is a cross-sectional side view of the segment gear taken along line 4-4 of FIG. 3.

As best shown in FIGS. 1 and 4, the top surface 104 also includes a step 138 proximate the arcuate wall 110. The step 138 is offset from the rest of the top surface 104. As the top side hub 126 straddles the step 138 and the rest of the top surface 104, vertical columns of material having varying thicknesses are provided in the region of the top side hub 126 and the arcuate wall 110.

It should be appreciated that a part having this geometry could not be formed as a unitary powder metal compact by a conventional powder metal compaction process. Typically, attempts to form top features, such as the hub 126, are made by transferring powder metal within the die cavity by a powder transfer motion of the lower tool members. As the powder is transferred, the powder fill to final part ratio along the vertical columns of the part must be approximately 2:1 to provide a part that is relatively uniformly dense after the compaction process.

However, a comparison of a horizontal cross section through the hub 126 and a horizontal cross section through the arcuate wall 110 with gear teeth 124 would reveal that there are areas of powder metal in the hub 126 which are not found in the arcuate wall 110 with gear teeth 124 and areas of powder metal in the arcuate wall 110 with gear teeth 124 that are not found in the hub 126. Thus, conventional tool and die sets are incapable of performing a powder transfer motion that provides an acceptable powder fill to final part ratio over a component having this final geometry. Instead, to fabricate a part of this type, the different sections are conventionally separately compacted and then joined afterwards.

Figure 5:
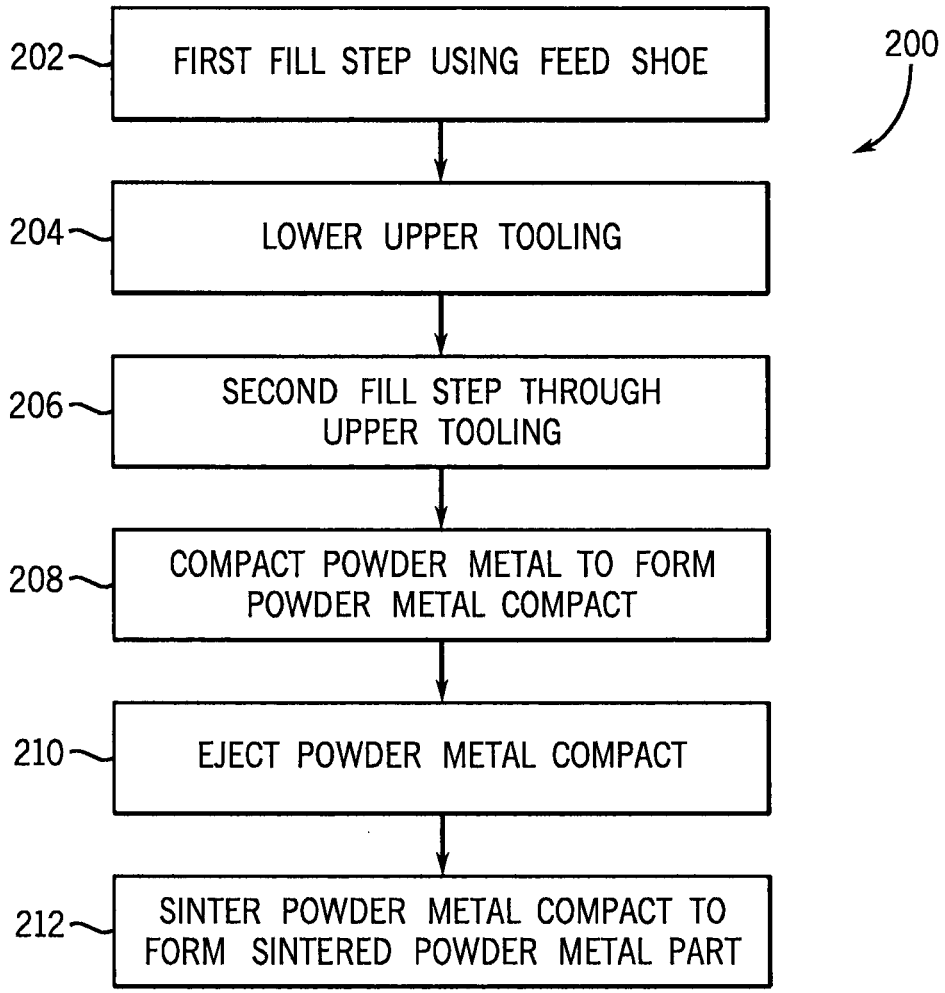
FIG. 5 is a flow chart outlining a set of steps for the fabrication of a complex part such as the segment gear.

Referring now to FIG. 5, a process 200 is outlined that allows for the formation of a single powder metal compact, and ultimately a sintered powder metal part, for a component having a geometry similar to the segment gear 100. With additional reference to FIGS. 6-10, which show specific steps of the filling and compaction steps, the steps of the process 200 will be described.

In order to form the powder metal compact, a tool and die set must be provided and installed in a compaction press. As shown in FIGS. 6-10, the tool and die set includes a die 300 having a die insert 302 that defines a portion of the die cavity 304. The die insert 302 is typically made of a hard tool material and is formed to have a shape similar to the outline of the periphery of the part. The lower tool members includes a lower core rod 306 which forms the through hole 116, a lower outer punch 308 surrounding the lower core rod 306 which forms the lower axial surface 112, and a lower tool member 310 which form the gear teeth 124. The lower tool members are inserted upward into the die cavity 304 so as to provide a bottom floor in the die cavity 304 and to provide side walls in locations which the die insert 302 would be incapable of forming side walls during compaction (e.g., the radially outward facing surfaces of the lower core rod 306 to form the splines 118 of the through hole 116). A number of upper tool members are also provided including an upper outer punch 312 sized to fit into a periphery of an upper portion of the die cavity 304, an upper middle punch 314 that is at least in part surrounded by the upper outer punch 312, and an upper inner punch 316 that is at least in part surrounded by the upper middle punch 314.

Figure 11:
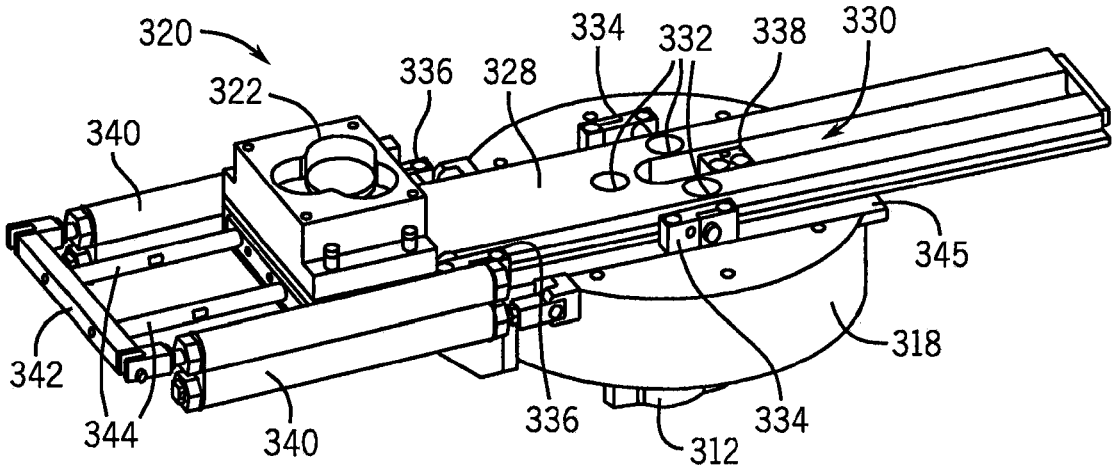
FIG. 11 is a perspective view of a feed plate assembly attached to a support block.
Figure 12:
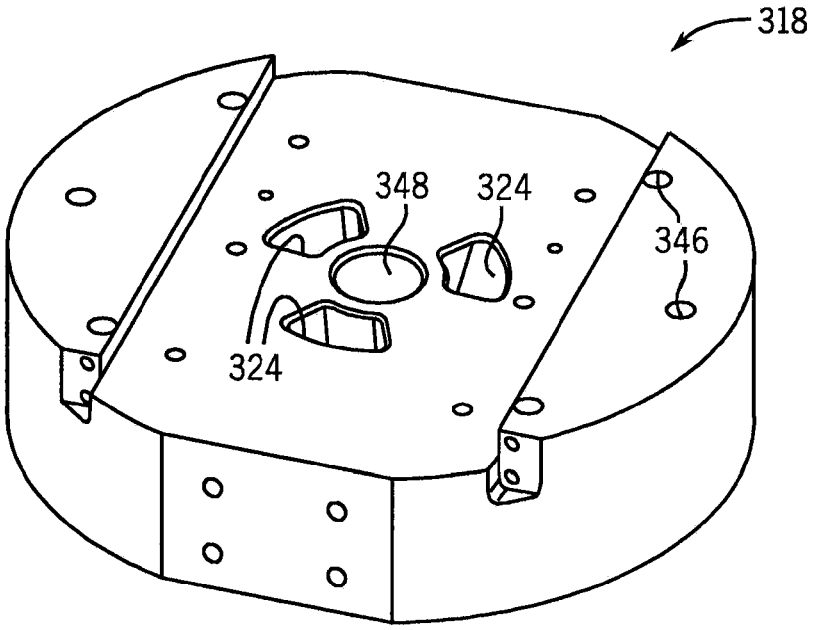
FIG. 12 is a top perspective view of a support block without the feed plate assembly or the upper outer punch attached.
Figure 13:
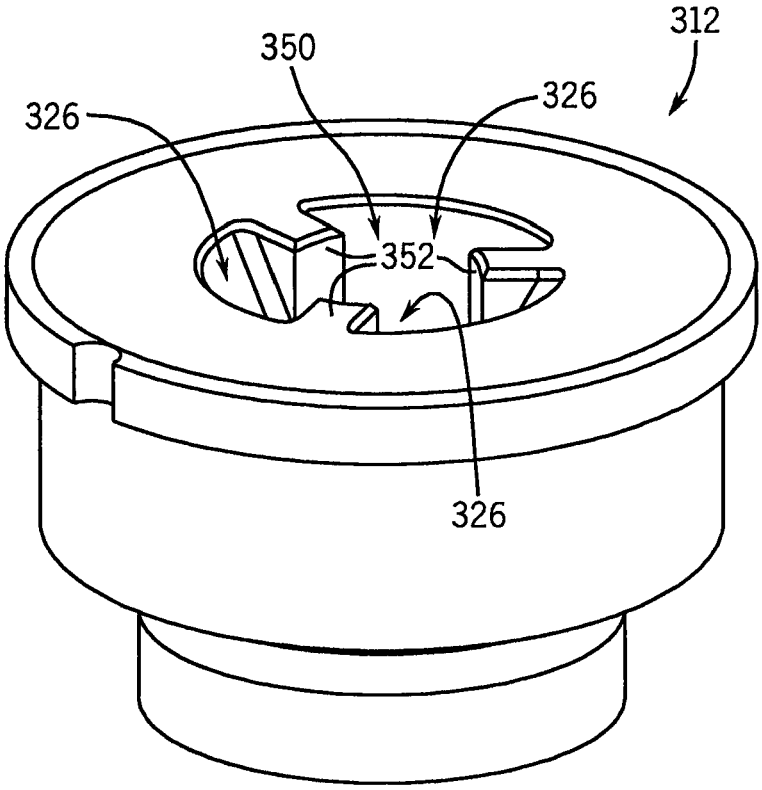
FIG. 13 is a top perspective view of the upper outer punch.

The upper tool members are configured such that a powder metal can be fed through at least one of the upper tool members. Referring now to FIGS. 11-13, a support block 318 is shown to which the upper outer punch 312 and a feed plate assembly 320 are attached. The support block 318 is mounted to a portion of the upper press assembly such that the support block 318, the upper outer punch 312, and the feed plate assembly 320 move together regardless of the positioning of the other upper tool members.

The feed plate assembly 320 shuttles charges of the powder metal from an axially offset hopper system 322 to powder feed chutes 324 and 326 that run through the support block 318 and the upper outer punch 312, respectively. The feed plate assembly 320 includes a sliding plate 328 that has a guide slot 330 and three powder cavities 332 which extend through the sliding plate 328. The linear path of the sliding plate 328 is guided by a track system that slidably connects sliding plate 328 to the support block 318. The track system includes front guides 334 and rear guides 336 that engage the lateral sides of the sliding plate 328 and a middle guide 338 that engages the walls of the guide slot 330.

The feed plate assembly 320 includes an actuation mechanism that moves the three powder cavities 332 of the sliding plate 328 back and forth between the hopper system 322 and the powder feed chutes 324 and 326. In the form shown, the actuation mechanism includes a set of cylinders 340 (shown retracted in FIG. 11), which can be extended and retracted to move a connecting bar 342 that is connected to the sliding plate 328 via a pair of linkages 344. Of course, other actuation mechanisms could be used to move the sliding plate 328. As will be described in more detail below, the particular timing of the shuttling of the powder metal from the hopper system 322 to the powder feed chutes 324 and 326 is timed with the press cycle.

The track system and actuation mechanism allows the sliding plate 328 to be movable between a first position (not shown) and a second position (shown in FIG. 11). In the first position, the powder cavities 332 are located under the hopper system 322 to receive a charge of powder metal. In the second position, the powder cavities 332 are slid over the support block 318 such that the bottom of the powder cavities 332 align with the upper openings of the powder feed chutes 324 in the support block 318 and are placed in communication with the powder feed chutes 324 and 326 of the support block 318 and upper outer punch 312, respectively. When the powder cavities 332 are in any position other than over the powder feed chutes 324 in the support block 318, a lower surface beneath the powder cavities 332 supplied by a support plate 345 (which also has holes aligning with the powder feed chutes 324) prevents the powder metal charge from dropping out of the bottom of the powder cavities 332.

Referring now to FIG. 12, the details of the support block 318 are shown. The support block 318 is generally cylindrically shaped with a number of bolt holes 346 for mounting the support block 318 to the upper press assembly. A number holes and/or chutes extend through the support block 318. A through hole 348 axially extends through the support block 318 to accommodate for the passage of the upper middle punch 314 and the upper inner punch 316 through the support block 318. Additionally, three powder feed chutes 324 or channels are situated about the through hole 348. As can be best seen in FIGS. 8 through 10, the three powder feed chutes 324 extend axially inward as the powder feed chutes 324 extend downward.

Referring now to FIG. 13, the details of the upper outer punch 312 are shown. The upper outer punch 312 has an opening 350 extending axially there through. When the upper outer punch 312 is mounted to the support block 318, the opening 350 has three powder feed chutes 326 which align with the exit ends of the three powder feed chutes 324 on the bottom face of the support block 318. These powder feed chutes 326 direct the powder metal downward and axially inward. Further, three walls 352 separate the feed chutes 326 from one another and guide the upper middle punch 314 (which has a complementary sliding fit with the inner diameter of the opening 350 as provided by the three walls 352) as the upper middle punch 314 extends through the upper outer punch 312.

Looking at the feed plate assembly 320, the support block 318, and the upper outer punch 312 in combination with the rest of the upper tool members, it should be observed that the particular design of the sliding plate 328 and powder feed chutes 324 and 326 is made to accommodate the extension of the upper middle punch 314 and the upper inner punch 316 through the other components. The slot 330 in the sliding plate 328, the through hole 348 in the support block 318, and the opening 350 of the upper outer punch 312 accommodate the passage and axial movement of the upper middle punch 314 and the upper inner punch 316 there through during the press cycle.

The movement of the upper middle punch 314 relative to the upper outer punch 312, allows openings 356 of the powder feed chutes 326 to be opened or closed by sliding a radially outward facing surface of the upper middle punch 314 past the openings 356 in the upper outer punch 312. The position of the powder cavities 332, and the powder feed chutes 324 and 326 that align with the powder cavities 332 in the second position, are designed to provide a relatively even distribution of powder metal through the upper tooling members into the annular chamber 354, when the upper middle punch 314 is sufficiently retracted, as will be described in more detail below.

The rest of the press and tool members will not be described in detail. However, those of ordinary skill in the art will appreciate that the press can be configured such that the stroke of each of the tool members relative to the die 300 can be controlled independently. Further, those having ordinary skill in the art will appreciate that other combinations of tool members could be substituted to perform similar functions. For example, the upper outer punch 312 could be replaced by two separate punches including a punch used to form the step 138 separate from the rest of the top surface 104. Likewise one or more lower tool members may be used to form the gear teeth 124.

Figure 6:
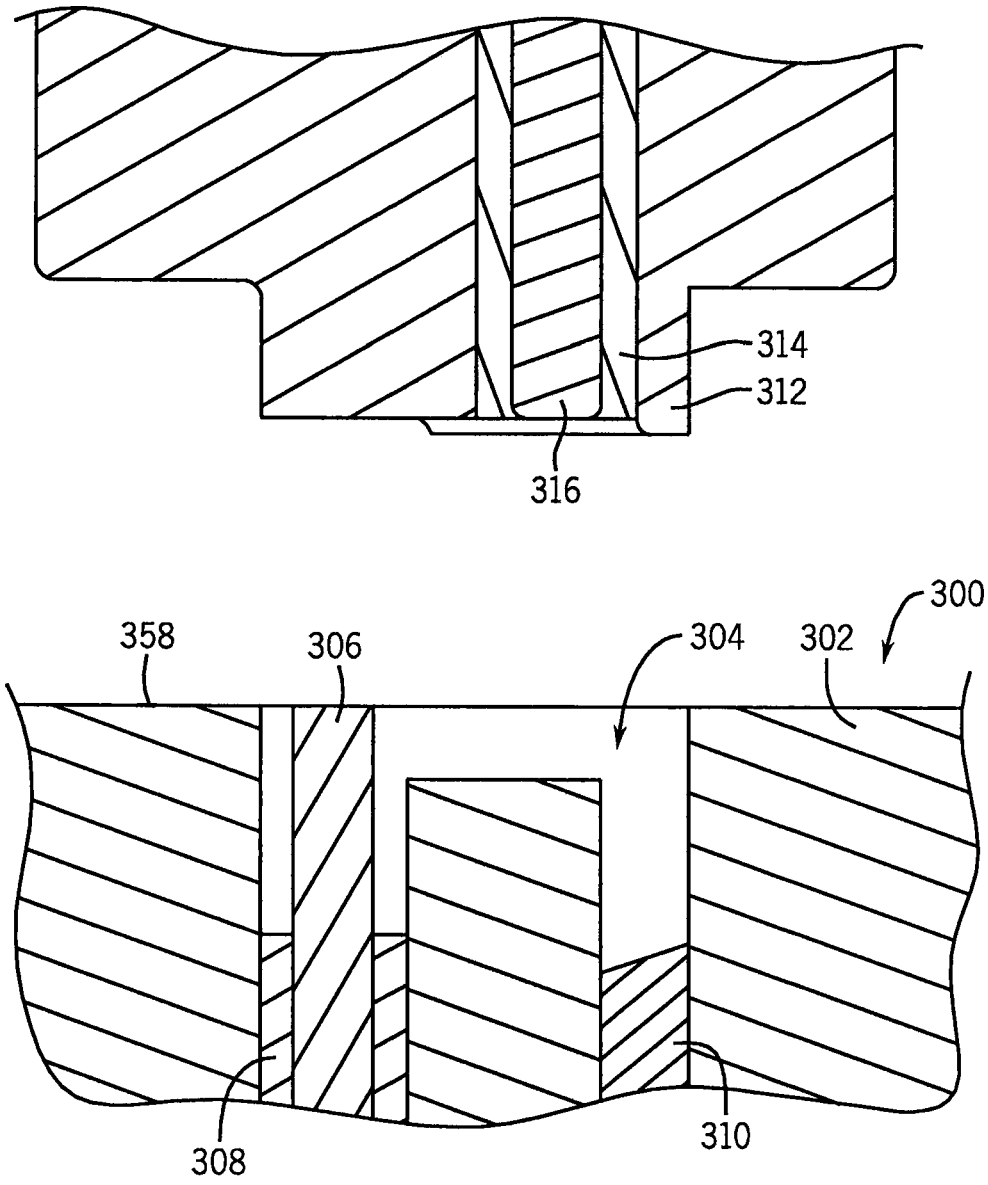
FIGS. 6-10 are cross-sectional views of a tool and die set in a compaction press in which the upper and lower tool members are in the first fill position before the first fill, the first fill position after the first fill, the second fill position after the upper tool members have been lowered but before the second fill, the second fill position after the second fill, and the compaction position, respectively.
Figure 10:
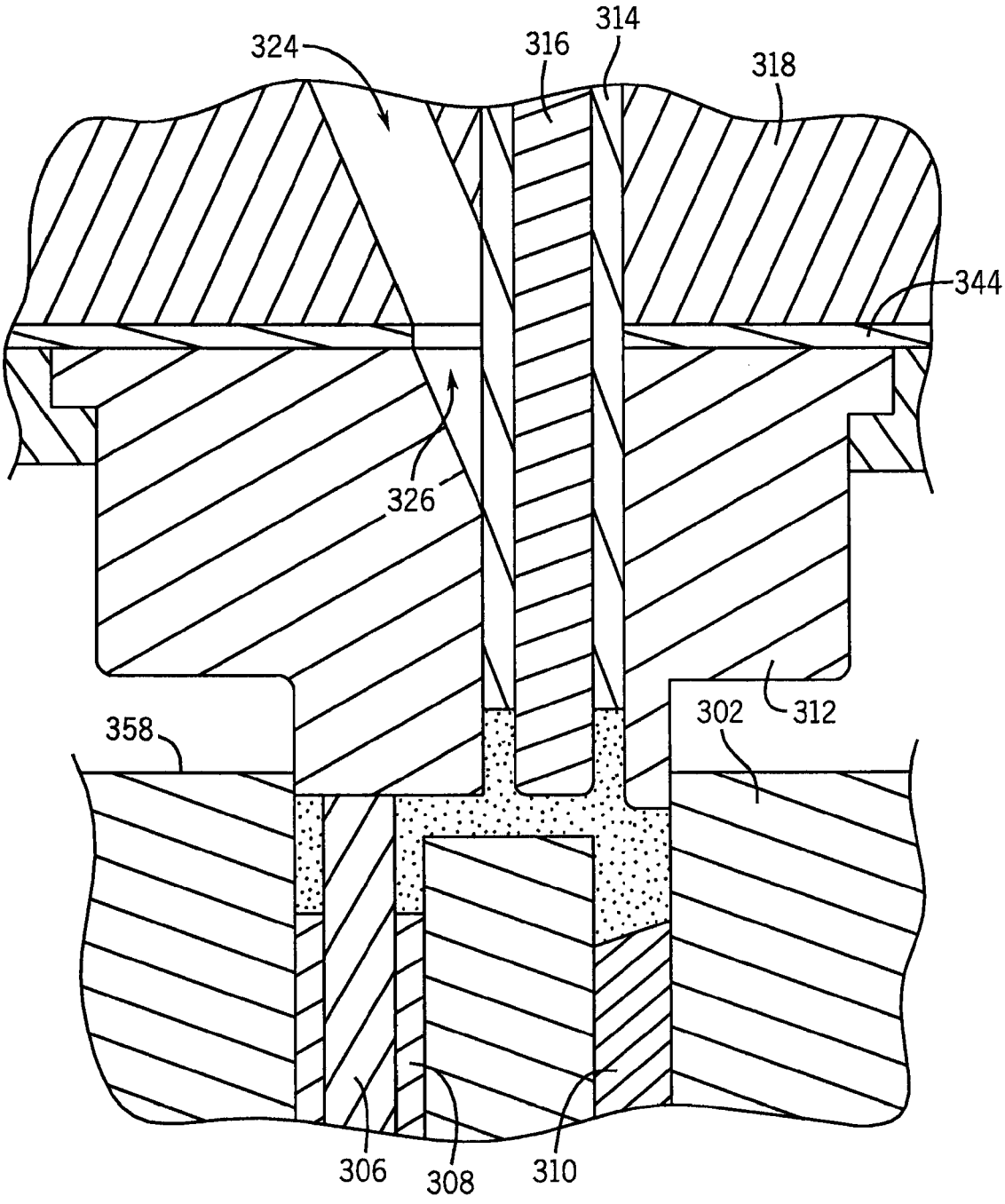

Referring now to FIG. 6, the filling and compaction steps begin with the lower core rod 306, lower outer punch 308, and lower tool member 310 being inserted in the die cavity 304 from below to form a bottom of the die cavity 304 and additional interior side walls. Although the lower tool members provides a base or floor of the die cavity 304, the lower tools are also retracted relative to their compaction position which is illustrated in FIG. 10. Prior to the powder filling, all of the upper tool members are initially in a lifted position above the die cavity 304.

Figure 7:
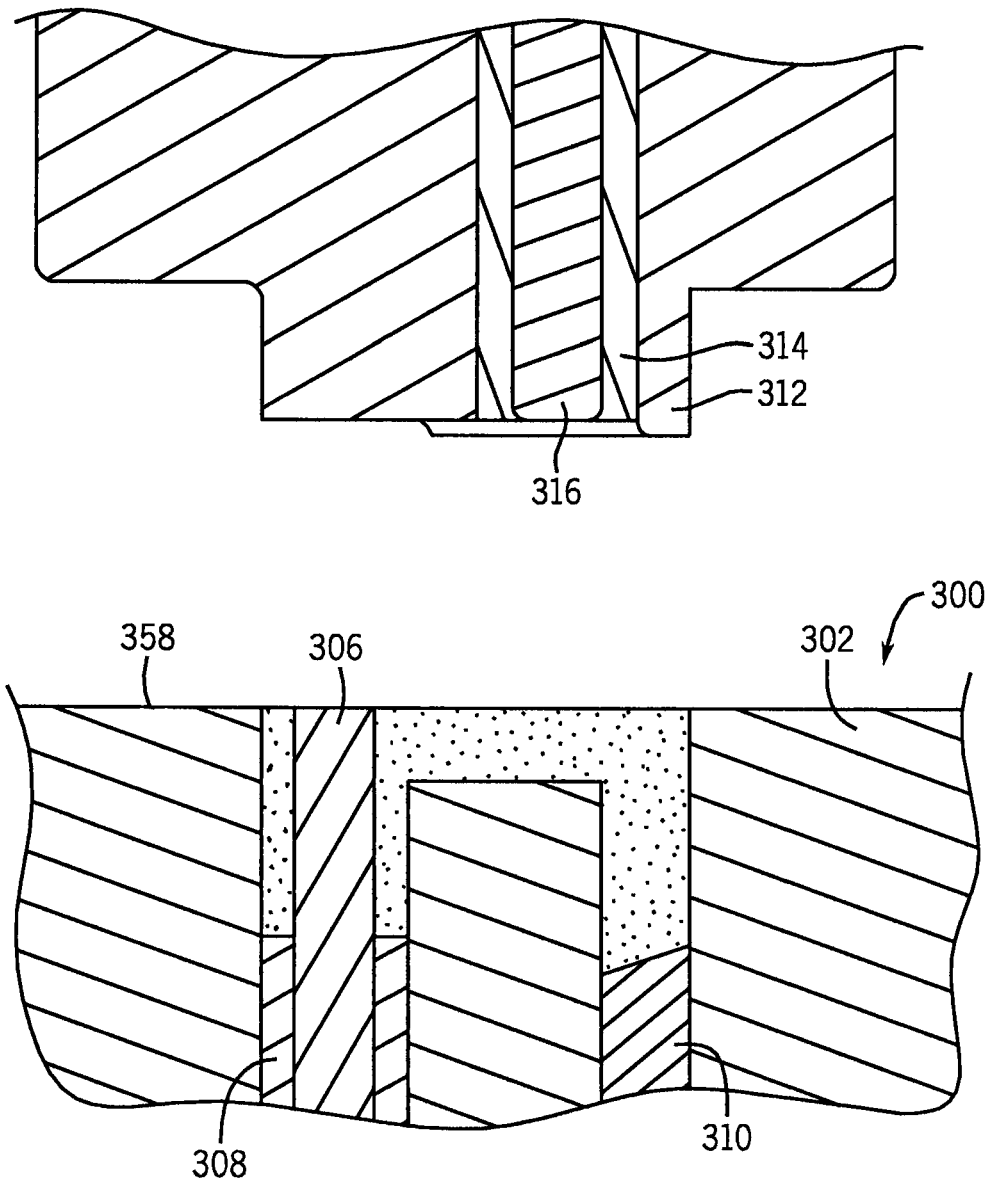

With the upper tool members lifted as shown in FIG. 6, a feed shoe (not shown) can be moved over the die cavity 304 to fill the die cavity 304 with a powder metal according to the first fill step 202. When the feed shoe is retracted from over the die cavity 304, the powder metal fill line in the die cavity 304 is level with an upper surface 358 of the die 300 as illustrated in FIG. 7.

Figure 8:
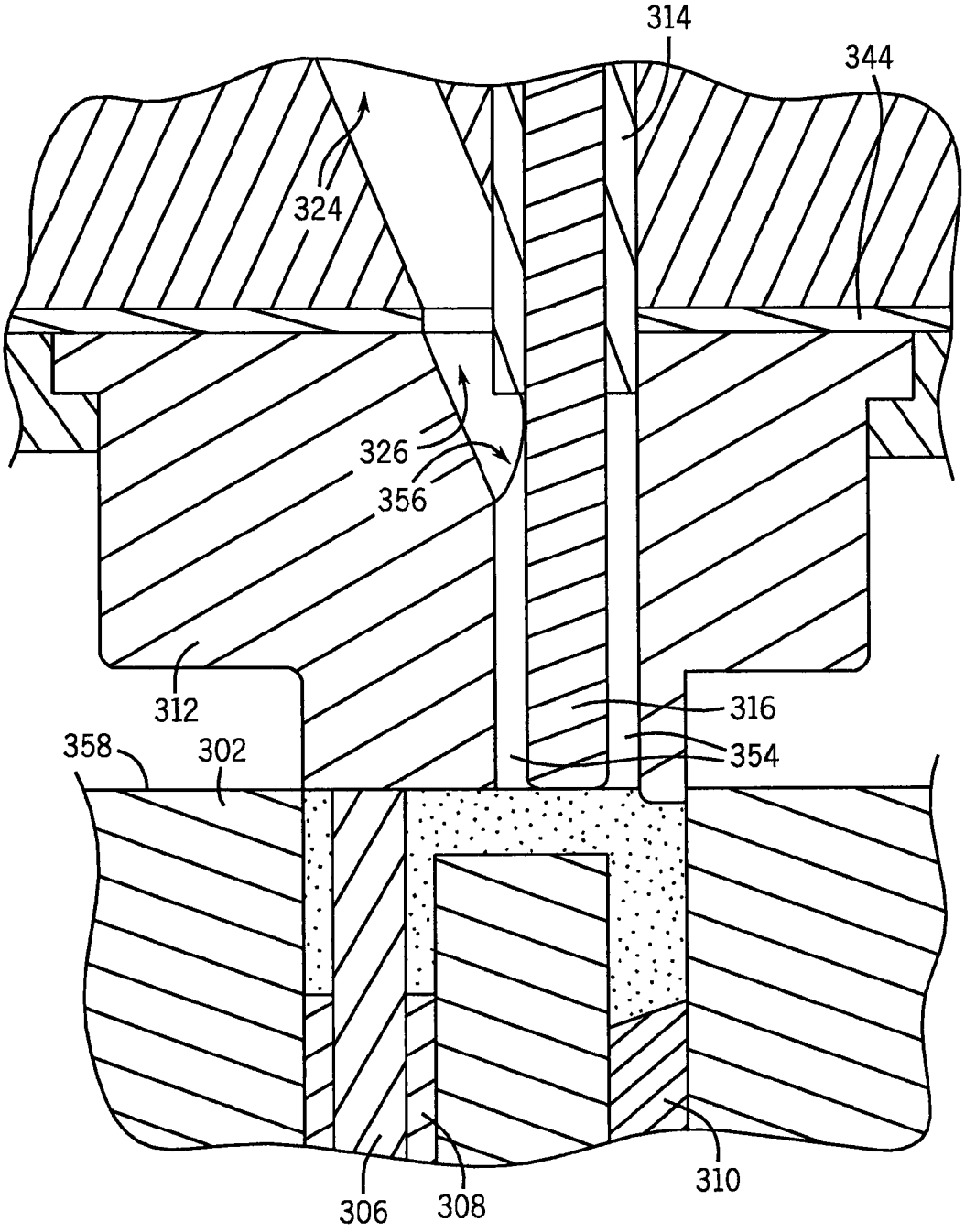

Next, at least some of the upper tool members are lowered towards the die cavity 304 according to step 204. As shown in FIG. 8, the upper outer punch 312 and the upper inner punch 316 are lowered to a point at which their lower axial faces are flush with (or slightly below) the powder metal fill line which corresponds to the upper surface 358 of the die 300. The upper outer punch 312 and the upper inner punch 316 may be brought into contact with the powder metal already in the die cavity 304 from the first fill step 202, but do not significantly compact the powder metal at this point in the process.

It is observed that the axial face of the upper outer punch 312 used to form the step 138 is slightly below the powder metal fill line in FIG. 8. Depending on the particular dimensions and compactability of powder metal, this slight compaction of the powder metal below the face of the upper outer punch 312 may be acceptable. However, if this slight compaction is not acceptable, then this condition may be remedied by replacing the one-piece upper outer punch with a two-piece upper outer punch having one piece that moves independently of the other piece that forms the step 138.

At some point, either before or after the upper tool members are lowered, the upper middle punch 314 is retracted relative to the upper outer punch 312 and the upper inner punch 316. This defines an annularly-shaped cylindrical space 354 between the upper outer punch 312 and the upper inner punch 316 that will be used to form the top side hub 126. It should be noted, however, that the timing and degree of the retraction of the upper middle punch 314 needs to be properly coordinated with the delivery of the powder metal charge by the feed plate assembly 320. When the upper middle punch 314 is retracted above the powder feed chutes 326 of the opening 350 in the upper outer punch 312, if powder is present in the powder feed chutes 326, the powder will be delivered by gravity into the space 354 between the upper outer punch 312 and the upper inner punch 316. If the upper tool members are not yet descended to a position such as that shown in FIG. 8, then the powder metal will be prematurely fed and not captured in the annularly-shaped cylindrical space 354.

When the upper tool members are lowered into the position shown in FIG. 8, the upper tool members, the lower tool members, and the die cavity define a pre-compaction chamber. The pre-compaction chamber includes a filled portion, which includes the bottom portion previously filled with powder metal during the first fill step 202, and an unfilled portion, which is the volume defined by the space 354 between the upper tool members above the powder metal fill line from the first fill step 202.

At this point, the powder metal from the upper tooling members is delivered to the unfilled portion of the pre-compaction chamber in a second fill step 206. This delivery is performed by shuttling powder metal via the powder cavities 332 of the sliding plate 328 from the hopper system 322 to the powder feed chutes 324 in the support block 318. Once the powder cavities 332 are aligned with the powder feed chutes 324 in the support block 318, gravity causes the powder metal in the powder cavities 332 to drop through the powder feed chutes 324 in the support block 318, through the powder feed chutes 326 in the upper outer punch 312, and into the annular space 354 (assuming the upper middle punch 314 is sufficiently retracted to place the powder feed chutes 326 in communication with the annular space 354). The charge of powder metal delivered to the unfilled portion of the pre-compaction chamber should provide an appropriate amount of powder metal to the unfilled portion of the pre-compaction chamber to form the top side hub 126. As the powder cavities 332 are of metered volume, the aggregate metered volume can be selected to be of a volume equal to the amount of powder metal to form the top side hub 126. Although only one set of powder feed chutes 324 and 326 are shown in the cross section of FIG. 8, as can be appreciated from FIGS. 11-13, there are, in fact, three powder feed chutes. Depending on the particular design of the tools there may be one or more powder feed chutes within the upper tool members.

Figure 9:
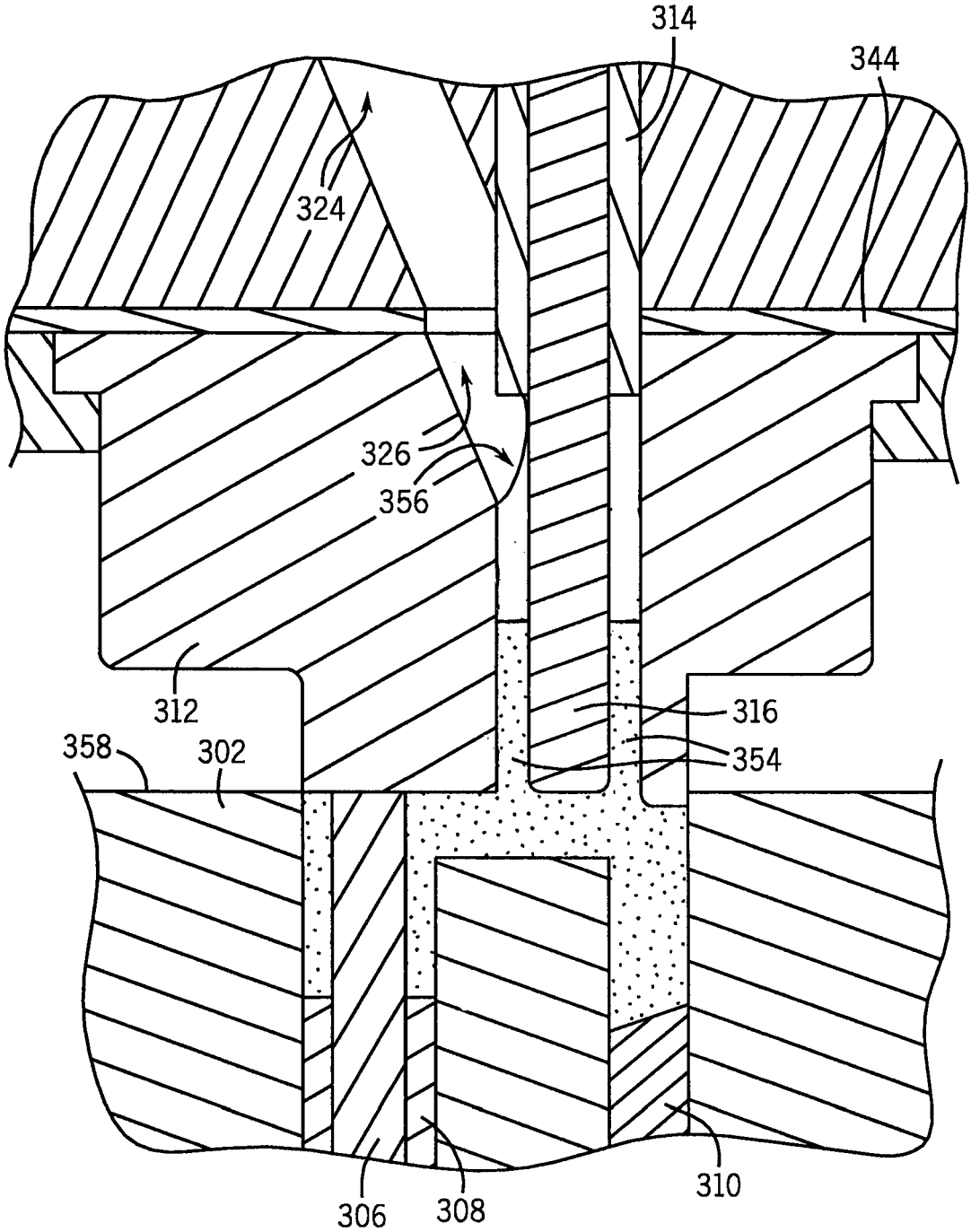

Once the second fill step 206 is complete as is illustrated in FIG. 9, then the powder fill to final part ratio should be approximately 2:1 in each of the vertical columns of powder. Of course, as some powder materials have different compressibilities or targeted compacted apparent densities, and so the exact ratio may differ.

After the second fill step 206, the powder metal is properly distributed within the pre-compaction chamber formed by the tool members and the die. Now the upper middle punch 314 is lowered to seal the openings 356 of the powder feed chutes 326, completely closing the pre-compaction chamber. At this point, the upper and lower tool members can compress the powder metal in the pre-compaction chamber according to the compaction step 208. The final tool placement at the end of the compaction step 208 is shown in FIG. 10. During compaction, the upper outer punch 312 and the upper inner punch 316 are moved downward into the die insert 302 to form the body section 102, the upper middle punch 314 is moved downward to form the top side hub 126, the lower outer punch 308 is extended upward to form the central hub 108, and the lower tool member 310 is moved upward to form the gear teeth 124. This forms a one piece powder metal compact having a geometry of the segment gear 100.

After the powder metal compact is formed, the powder metal compact is ejected from the tools and die in an ejection step 210. During ejection, the upper and lower tool members are retracted in a coordinated sequence to separate the powder metal compact from the surfaces of the upper and lower tools and die. Typically, the upper outer punch 312 and upper inner punch 316 would be retracted first, while the upper middle punch 314 held the upper axial surface 132 of the top side hub 126 in place to prevent the compacted top side hub 126 from fracturing due to upward force on the radially-facing walls. Once the upper tool members are removed from the powder metal compact, the lower tools are raised to an eject position in which the bottom side features are ejected from the walls of the die cavity 304. Of course, the ejection sequence may vary based on part geometry and the die and tool members used to form the powder metal compact.

Finally, the powder metal compact may be sintered according to step 212, by processes well known in the art. During sintering, the powder metal compact is heated to temperatures below the melting point of the powder metal in a controlled atmosphere to cause the powder metal particles to diffuse, resulting in the particles necking together, and forming a strong solid sintered part. During sintering the part dimensions may shrink as porosity decreases, but the part maintains its general shape. To account for this shrinkage, the powder metal compact is typically engineered to be slightly larger than the final sintered part.

Additionally, the sintered part may be subjected to any number of finishing or secondary process. The sintered part could be deburred, machined, heat treated, carburized, coined, forged, or subjected to any of a number other post-sintering operations known to those of ordinary skill in the art.

Although a method has been disclosed to create a segment gear having a hub on the top and a central hub and axially-oriented gear teeth on the bottom, the disclosed method is applicable to any part having asymmetric top and bottom features in which lower tool members are incapable of performing a powder transfer motion necessary to achieve sufficient powder fill to final part ratios.

It should also be noted that various spacer plates may be incorporated in the tool design and press set up. To the extent necessary, such spacer plates or other support blocks may also be formed to include holes or powder feed chutes to allow for the delivery of powder through the upper tool members.

It should further be appreciated that the powder feed chute need not necessarily extend to the lowest upper tool member. For example, the powder feed chute opening which places the chute in communication with the pre-compaction chamber could be formed in the support block 318, although in the tool setup shown, this would require lifting the upper middle punch 314 past this opening during the top fill step. It will be appreciated that one having skill in the art would recognize that this and other such modifications to the tool set could be made to achieve the same top fill capability.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of forming a powder metal compact using a tool set including a die having a die cavity, at least one lower tool member, and at least one upper tool member, the method comprising:

inserting the at least one lower tool member into the die cavity;

filling the die cavity with a powder metal in a first fill step;

lowering the at least one upper tool member to define a pre-compaction chamber, the pre-compaction chamber including a filled section that was filled with the powder metal during the first fill step and an unfilled section that is not yet filled with the powder metal;

filling the unfilled section of the pre-compaction chamber with powder metal in a second fill step via at least one powder feed chute that extends through the at least one upper tool member into the pre-compaction chamber;

compacting the powder metal along an axis of compaction to form a powder metal compact; and ejecting the powder metal compact from the die cavity;

wherein the second fill step includes shuttling the powder metal from a hopper system to the at least one powder feed chute in the at least one upper tool member using a feed plate assembly including a sliding plate having at least one powder cavity of a metered volume formed therein, the sliding plate being moveable between a first position in which the at least one powder cavity is located beneath the hopper system to receive a charge of powder metal equal in volume to the at least one powder cavity and a second position in which the at least one powder cavity is placed in communication with the at least one powder feed chute in the at least one upper tool member to allow the charge of powder metal to be fed to the pre-compaction chamber.

2. A method of claim 1, further comprising a support block having the feed plate assembly positioned on a top side thereof and an upper tool member attached to a bottom side thereof and wherein the support block includes at least one powder feed chute that places the at least one powder cavity of the sliding plate in communication with the at least one powder feed chute of the upper tool member when the sliding plate is in the second position.

3. A method of claim 1, wherein the sliding plate includes a slot through which at least one upper tool member extends in both the first position and the second position of the sliding plate.

4. A method of claim 3, wherein the sliding plate includes a plurality of powder cavities and the plurality of powder cavities are not co-axial with the at least one upper tool member that extends through the slot in the sliding plate.

5. A method of forming a powder metal compact using a tool set including a die having a die cavity, at least one lower tool member, and at least one upper tool member, the method comprising:

inserting the at least one lower tool member into the die cavity;

filling the die cavity with a powder metal in a first fill step;

lowering the at least one upper tool member to define a pre-compaction chamber, the pre-compaction chamber including a filled section that was filled with the powder metal during the first fill step and an unfilled section that is not yet filled with the powder metal;

filling the unfilled section of the pre-compaction chamber with powder metal in a second fill step via at least one powder feed chute that extends through the at least one upper tool member into the pre-compaction chamber;

compacting the powder metal along an axis of compaction to form a powder metal compact; and ejecting the powder metal compact from the die cavity;

wherein the tool set includes an upper inner punch, an upper middle punch surrounding at least a portion of the upper inner punch, and an upper outer punch surrounding at least a portion of the upper middle punch.

6. A method of claim 5, wherein the at least one powder feed chute in the at least one upper tool member extends through the at least one upper tool member at an angle relative to the axis of compaction.

7. A method of claim 5, wherein the step of lowering the at least one upper tool member to define the pre-compaction chamber includes lowering the upper outer punch.

8. A method of claim 7, wherein the step of lowering the at least one upper tool member to define the pre-compaction chamber further includes lowering the upper inner punch.

9. A method of claim 7, wherein, during the second fill step, the upper middle punch is in a retracted position to place the at least one powder feed chute of the upper outer punch in communication with the pre-compaction chamber and wherein, during the step of compacting the powder metal, the upper middle punch is lowered such that a surface of the upper middle punch slides past an opening of the at least one powder feed chute to remove the powder feed chute from communication with the pre-compaction chamber.

10. A method of forming a powder metal compact using a tool set including a die having a die cavity, at least one lower tool member, and at least one upper tool member, the method comprising:

inserting the at least one lower tool member into the die cavity;

filling the die cavity with a powder metal in a first fill step;

lowering the at least one upper tool member to define a pre-compaction chamber, the pre-compaction chamber including a filled section that was filled with the powder metal during the first fill step and an unfilled section that is not yet filled with the powder metal;

filling the unfilled section of the pre-compaction chamber with powder metal in a second fill step via at least one powder feed chute that extends through the at least one upper tool member into the pre-compaction chamber;

compacting the powder metal along an axis of compaction to form a powder metal compact; and ejecting the powder metal compact from the die cavity;

wherein the powder metal compact has at least two different cross sections taken perpendicular to the axis of compaction of the powder metal compact and wherein each of the at least two different cross sections have a first filled powder area that is not included in the other of the at least two different cross sections and a second filled powder area that is included in the other of the at least two different cross sections;

wherein a top fill on the powder metal compact is achieved by the second fill step and not by a powder transfer motion of the at least one lower tool member.

11. A method of claim 10, wherein the first fill step is performed by placing a feed shoe over the die cavity and wherein a powder metal fill line in the die cavity is level with an upper surface of the die.

12. A method of claim 10, wherein the second fill step is performed by gravity.

13. A method of claim 10, wherein the step of lowering the at least one upper tool member to define a pre-compaction chamber includes moving a lower surface of the at least one upper tool member flush with a powder metal fill surface of the powder metal from the first fill step.

14. A method of claim 10, wherein a ratio of a powder fill to a final powder metal compact is approximately 2:1.

15. A method of claim 10, further comprising the step of sintering the powder metal compact to form a sintered powder metal part.

* * * * *